US005411770A

United States Patent [19]

Tsai et al.

[11] Patent Number: 5,411,770

[45] Date of Patent: May 2, 1995

[54] METHOD OF SURFACE MODIFICATION OF STAINLESS STEEL

[75] Inventors: Wen-Ta Tsai; Ju-Tung Lee, both of Tainan; Tai-Hwang Lai, I-Lan, all of Taiwan, Prov. of China

[73] Assignee: National Science Council, Taipei, Taiwan, Prov. of China

[21] Appl. No.: 266,046

[22] Filed: Jun. 27, 1994

[51] Int. Cl.[6] ..... C23C 24/10

[52] U.S. Cl. ..... 427/556; 427/581; 427/554; 148/241; 148/224; 148/565

[58] Field of Search ..... 148/241, 224, 565; 427/581, 554, 556

[56] References Cited

U.S. PATENT DOCUMENTS 4,212,900 7/1980 Serlin ..... 148/565

FOREIGN PATENT DOCUMENTS 0197879 10/1985 Japan ..... 427/454

0251282 12/1985 Japan ..... 427/454

*Primary Examiner*—Sam Silverberg

*Attorney, Agent, or Firm*—Townsend and Townsend Khourie and Crew

[57] ABSTRACT

The surface of stainless steel can be hardened by coating a silicon nitride gel and then scanning by $CO_2$ laser to form a surface alloy layer thereon. The thickness and hardness of the surface alloy layer are both uniform. The Vicker's hardness of the layer can be as high as 1200 Hv. This method can be operated in a common atmosphere or nitride atmosphere at normal pressure, therefore it is more economic than ion nitriding or plasma nitriding.

28 Claims, 3 Drawing Sheets

METHOD OF SURFACE MODIFICATION OF STAINLESS STEEL

FIELD OF THE INVENTION

The present invention relates to a method of surface modification of stainless steel, especially to a method of surface modification of stainless steel using a laser treatment to improve its surface hardness.

BACKGROUND OF THE INVENTION

Stainless steel is a well-known alloy which is widely used to avoid corrosion. However, because of its limited hardness, it is not durable, which limits its use. If stainless steel is coated with wear-proof materials of high hardness or treated to increase its surface hardness, it will become more suitable for applications that require durability.

Conventional surface hardening techniques include gas nitriding, etc. These methods have some common disadvantages. For example, the hardened layer is too thin, and the hardness decreases rapidly with depth. Therefore, surface hardening methods for stainless steel that result in a thicker hardened layer and uniform hardness of the hardened layer are continuously being sought.

Surface hardening methods commonly used nowadays that have thicker hardened layer and uniform hardness in the hardened layer include ion nitriding and plasma nitriding. But these methods must be used in a vacuum, and consume time and energy. Therefore, research is underway for simple, quick, energy-saving and non-pollutive surface hardening methods.

SUMMARY OF THE INVENTION

It is therefore an object of the present invention is to provide a method to increase the surface hardness of stainless steel, so as to improve its wear resistance.

Another object of the present invention is to provide a method to increase its resistance to corrosion at the same time.

If the stainless steel contains more silicon, its resistance to oxidation at high temperature will be increased, and its resistance to local corrosion, like pitting, will be improved as well. Consequently, forming a silicon-rich alloy surface layer on the stainless steel will be an economical way to improve its resistance to wear and corrosion, while preserving its strength and ductility.

The above objects are fulfilled by providing a method of modifying the surface of stainless steel. The method comprises the following steps of: (a) cleaning the surface by mechanical means; (b) coating a silicon nitride gel on the surface; (c) drying the surface; (d) melting the surface by $CO_2$ laser; and (e) cleaning the surface by ultrasonic means.

BRIEF DESCRIPTION OF THE DRAWING

The present invention will become more fully understood from the detailed description given hereinafter with reference to the accompanying drawings which are given by way of illustration only, and thus are not limitative of the present invention and wherein.

DETAILED DESCRIPTION OF THE PRESENT INVENTION

Figure 1:
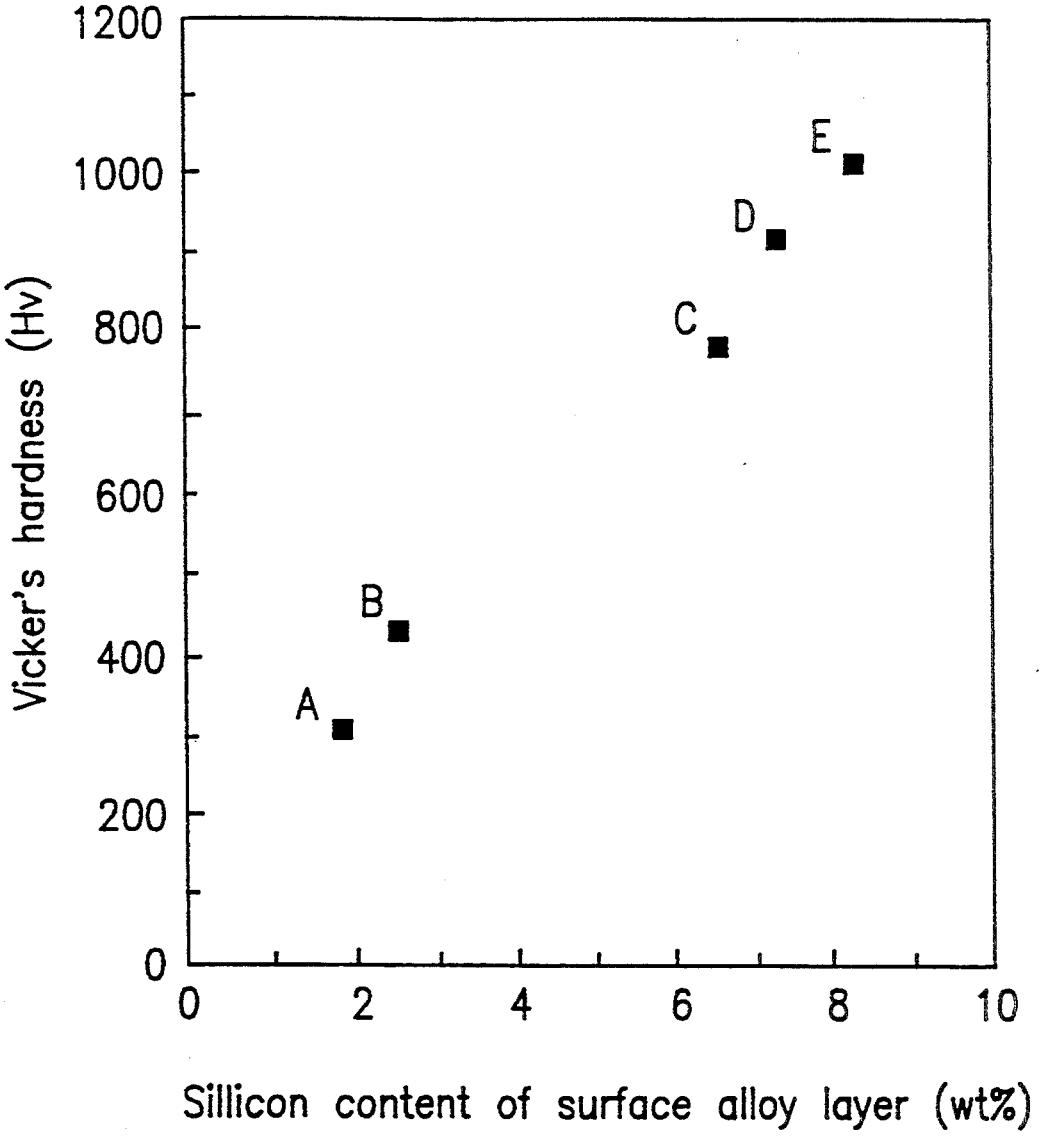
FIG. 1 shows the Vicker's hardness varying with the content of silicon in the alloy surface layer.

The surface hardening method according to the present invention can be briefly described as follows. First, the surface of the work piece of stainless steel is cleaned by mechanical means (grinding or sandblasting). Then the surface of the stainless steel is coated with silicon nitride gel of 0.01 to 1 mm solvated by polyethylene glycol. After being desiccated under 40° to 100° C., the surface is scanned and melted by $CO_2$ laser at a power density of 50 to 500 $KW/cm^2$. The silicon nitride gel reacts with the stainless steel to form a hardened surface alloy layer. Finally, the work piece is cleaned again in water by ultrasonic means.

The main object of the grinding or sandblasting procedure is to remove impurities or oxides on the surface, to prevent impurities from contaminating the surface alloy layer. In the mean time, the surface roughness will be increased after this procedure, which facilitates the adhesion of silicon nitride gel. Silicon carbonate sandpaper of #180 to #600 is suitable for grinding. Silica sand or other mineral sand can be used in sandblasting.

The silicon nitride gel will dissolve into silicon and nitrogen at high temperature when scanned by a $CO_2$ laser. Silicon will dissolve in the surface of the stainless steel. Polyethylene glycol acts as a carrier of the silicon nitride in this process. Therefore, the silicon content of the surface of the stainless steel is increased, resulting in improved hardness and durability of the stainless steel surface.

In addition, by varying the concentration of silicon nitride and the thickness of silicon nitride gel, the thickness and the silicon content of the surface alloy layer can be adjusted. As the silicon content increases, the resistance to corrosion and the hardness of the surface alloy layer increases. The power output of the laser and the relative speed between the laser beam and the work piece also affect the resultant resistance to corrosion and hardness of the surface alloy layer.

The results of several examples of the surface hardening process according to the present invention will be discussed in detail hereinafter.

EXAMPLE 1

AISI 316L stainless steel was used as substance to be treated. The thickness of silicon nitride gel was 0.3 mm. The power output of $CO_2$ laser was 200 W. The scanning speed of the laser beam was 8.4 mm/sec. The scanned area was overlapped by 50%. The composition of the surface alloy layer was analyzed by spectrograph as listed in Table 1, wherein the silicon was found to be 5.9%.

TABLE 1

Analysis of the surface alloy layer composition (wt %)

| | Fe | Cr | Ni | Mo | Mn | Si |
|---|---|---|---|---|---|---|
| ex. 1 | 61.4 | 16.9 | 11.7 | 2.3 | 1.8 | 5.9 |
| ex. 2 | 55.6 | 17.8 | 12.2 | 3.2 | 2.2 | 9.0 |
| ex. 3 | 72.9 | 16.3 | 0 | 0 | 0 | 10.8 |
| ex. 4 | 65.6 | 15.4 | 0 | 0 | 0 | 19.0 |

EXAMPLE 2

All parameters were the same as in example 1 except that the thickness of the silicon nitride gel was 0.5 mm and the power output of the $CO_2$ laser was 300 W. The surface alloy layer composition was analyzed by spectrograph as listed in Table 1, wherein the silicon was found to be 9.0%.

EXAMPLE 3

The substance to be treated was AISI 430 stainless steel. The power output of the $CO_2$ laser was 400 W. The scanning speed was 15.1 mm/sec. The laser beam was scanned line by line. Other parameters was the same as in example 1. The surface alloy layer composition was analyzed by spectrograph as listed in Table 1, wherein the silicon was found to be 10.8%.

EXAMPLE 4

All parameters were the same as in example 3 except that the scanned area was overlapped by 50%. The surface alloy layer composition was analyzed by spectrograph as listed in Table 1, wherein the silicon was found to be 19.0%.

From FIG. 1 it is shown that the Vicker's hardness of the surface alloy layer rises from 300 Hv to 1200 Hv as the content of silicon increases.

Figure 2:
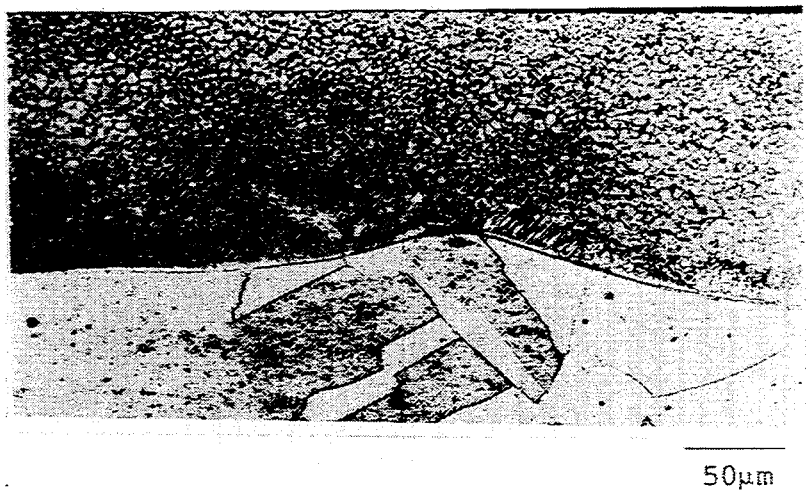
FIG. 2 shows the microstructure of the cross section of the alloy surface layer in the second embodiment of the present invention.

FIG. 2 shows the microstructure of a cross section of the alloy surface layer. It is noticed that the surface alloy layer adheres well to the substance, and is quite uniform. The thickness of the surface alloy layer remains unchanged.

Figure 3:
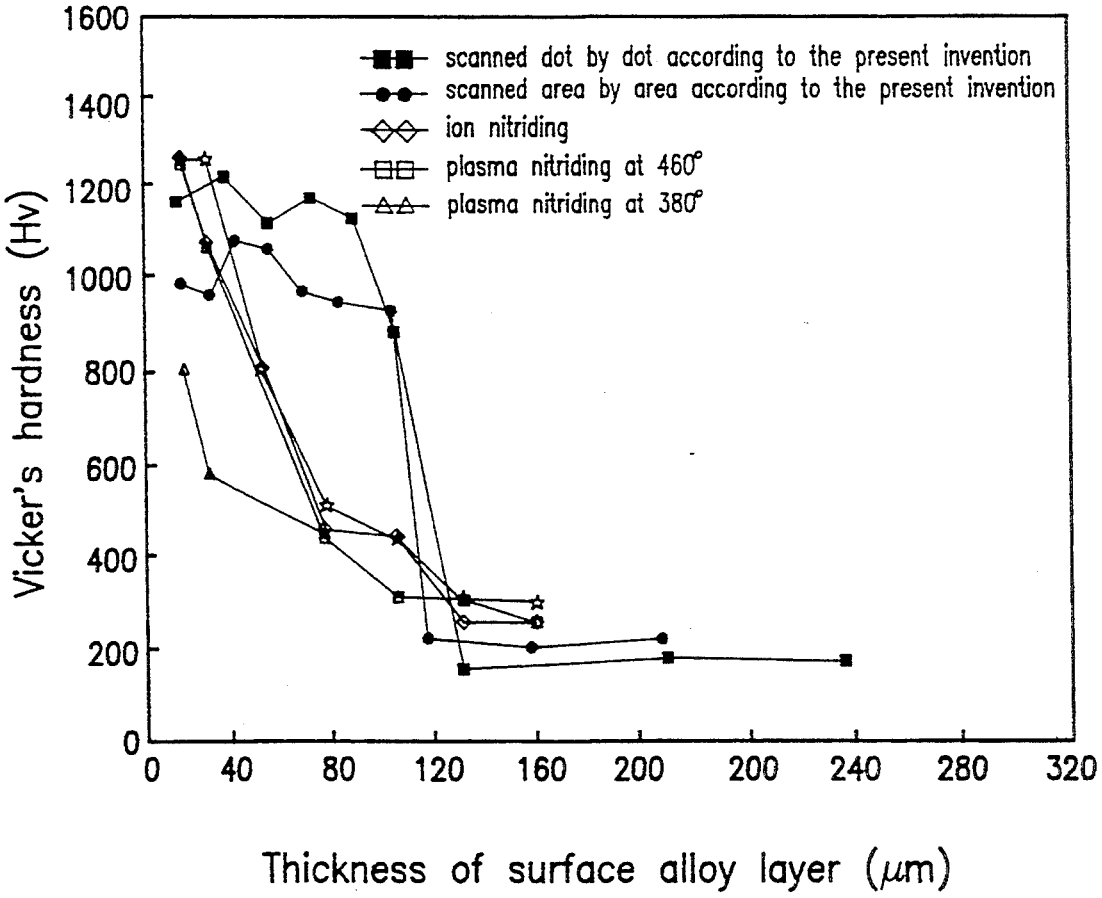
FIG. 3 shows the relation of hardness and depth of the alloy surface layer treated according the present invention and conventional nitriding methods.

A comparison between the present invention and conventional ion nitriding and plasma nitriding methods is shown in FIG. 3. The present invention produces a thicker surface alloy layer (280 μm) than conventional methods (160 μm). The hardness of the surface alloy layer produced according to the present invention is 1200 Hv from 20 to 110 μm. At the same depth, the hardness drops from 1250 Hv to 300 Hv in ion nitriding, from 1250 Hv to 300 Hv in plasma nitriding under 460° C., and from 800 Hv to 400 Hv in plasma nitriding under 380° C. It is obvious that the surface alloy layer produced according to the present invention has much better mechanical properties.

Another advantage of the present invention is economy. Since the method according to the present invention need not be used in a vacuum, it is much simpler, time-saving, energy-saving and non-pollutive, and requires no expensive vacuum equipment.

It should also be noted that the present invention can be applied not only to the stainless steels used in the examples, but to stainless steels such austenites, ferrites, martensites or dual-phase stainless steels as well. Furthermore, the scanning process can be operated on a circulating cooled computer-numeric-controlled X-Y working plate in a nitride atmosphere. The power output of the $CO_2$ laser can be between 100 and 4000 W. The power density of the laser beam can be anywhere from 50 to 5000 $KW/cm^2$. The scanning speed of the laser beam can be between 0 and 100 mm/sec. The laser beam can be scanned dot by dot, line by line, or the scanned area can be overlapped by anywhere from 10 to 80%. The silicon content of the surface alloy layer can be between 1 and 19 wt %. The thickness of the surface alloy layer can vary from 10 to 1000 μm. The hardness of the surface alloy layer can be uniform. The Vicker's hardness of the surface ally layer can be between 300 and 1200 Hv.

While the invention has been described by way of examples and in terms of several preferred embodiments, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A method of modifying the surface of stainless steel, comprising the following steps of:

(a) cleaning the surface by mechanical means;

(b) coating a silicon nitride gel on the surface;

(c) drying the surface; and (d) scanning and melting the surface by $CO_2$ laser, thereby causing the gel to react with the surface of the stainless steel to form a hardened surface alloy layer with increased silicon content.

2. A method of modifying the surface of a stainless steel as claimed in claim 1, wherein the stainless steel is austenite.

3. A method of modifying the surface of a stainless steel as claimed in claim 1, wherein the stainless steel is ferrite.

4. A method of modifying the surface of a stainless steel as claimed in claim 1, wherein the stainless steel is martensite.

5. A method of modifying the surface of a stainless steel as claimed in claim 1, wherein the stainless steel is dual-phase stainless steel.

6. A method of modifying the surface of a stainless steel as claimed in claim 1, wherein said step (a) comprises grinding the surface.

7. A method of modifying the surface of a stainless steel as claimed in claim 1, wherein said step (a) comprises grinding the surface using silicon carbonate sandpaper of between #180 and #600.

8. A method of modifying the surface of a stainless steel as claimed in claim 1, wherein said step (a) comprises sandblasting the surface.

9. A method of modifying the surface of a stainless steel as claimed in claim 1, wherein said step (a) comprises sandblasting the surface using silica sand.

10. A method of modifying the surface of a stainless steel as claimed in claim 1, wherein said step (a) comprises sandblasting the surface using mineral sand.

11. A method of modifying the surface of a stainless steel as claimed in claim 1, wherein said step (a) comprises sandblasting the surface using silica sand and mineral sand.

12. A method of modifying the surface of a stainless steel as claimed in claim 1, wherein said silicon nitride gel is solvated by polyethylene glycol.

13. A method of modifying the surface of a stainless steel as claimed in claim 12, wherein the thickness of said silicon nitride gel is between 0.01 and 1 mm.

14. A method of modifying the surface of a stainless steel as claimed in claim 1, wherein the surface is dried at 40° to 100° C. in said step (c).

15. A method of modifying the surface of a stainless steel as claimed in claim 1, wherein said step (d) is operated on a circulating cooled computer-numeric-controlled X-Y working plate.

16. A method of modifying the surface of a stainless steel as claimed in claim 1, wherein said step (d) is operated in a nitride atmosphere.

17. A method of modifying the surface of a stainless steel as claimed in claim 1, wherein the power output of said $CO_2$ laser is 100 to 4000 W.

18. A method of modifying the surface of a stainless steel as claimed in claim 1, wherein the power density of the laser beam of said $CO_2$ laser is 50 to 5000 $KW/cm^2$.

19. A method of modifying the surface of a stainless steel as claimed in claim 1, wherein the scanning speed of the laser beam of said $CO_2$ laser is 0 to 100 mm/sec.

20. A method of modifying the surface of a stainless steel as claimed in claim 1, wherein the surface is scanned dot by dot in said step (d).

21. A method of modifying the surface of a stainless steel as claimed in claim 1, wherein the surface is scanned line by line in said step (d).

22. A method of modifying the surface of a stainless steel as claimed in claim 1, wherein the surface is scanned area by area in said step (d).

23. A method of modifying the surface of a stainless steel as claimed in claim 1, wherein the scanned area of the surface is overlapped by 10 to 80%.

24. A method of modifying the surface of a stainless steel as claimed in claim 1, wherein the silicon content of the surface after said step (d) is 1 to 19 wt%.

25. A method of modifying the surface of a stainless steel as claimed in claim 1, wherein the surface forms an alloy layer having a thickness from 10 to 1000 $\mu$m.

26. A method of modifying the surface of a stainless steel as claimed in claim 25, wherein said alloy layer has a uniform hardness.

27. A method of modifying the surface of a stainless steel as claimed in claim 25, wherein said alloy layer has a Vicker's hardness of between 300 and 1200 Hv.

28. A method of modifying the surface of a stainless steel, comprising the following steps of:

(a) cleaning the surface by mechanical means;

(b) coating a silicon nitride gel on the surface;

(c) drying the surface;

(d) melting the surface by $CO_2$ laser, thereby causing the gel to react with the surface of the stainless steel to form a hardened surface alloy layer with increased silicon content.

* * * * *